US010823375B2

(12) United States Patent
Zhang et al.

(10) Patent No.: US 10,823,375 B2
(45) Date of Patent: Nov. 3, 2020

(54) LIGHT COVER ASSEMBLING STRUCTURE OF A CEILING FAN

(71) Applicant: FOSHAN CARRO ELECTRICAL CO., LTD., Foshan (CN)

(72) Inventors: Jiansheng Zhang, Foshan (CN); Zhiqiang Yuan, Foshan (CN)

(73) Assignee: Foshan Carro Electrical Co., Ltd., Foshan (CN)

( * ) Notice: Subject to any disclaimer, the term of this patent is extended or adjusted under 35 U.S.C. 154(b) by 0 days.

(21) Appl. No.: 16/675,484

(22) Filed: Nov. 6, 2019

(65) Prior Publication Data

US 2020/0208809 A1 Jul. 2, 2020

(30) Foreign Application Priority Data

Dec. 29, 2018 (CN) ..... 2018 2 2254798 U

(51) Int. Cl.

| | |
|---|---|
| ***F21V 17/16*** | (2006.01) |
| ***F21S 8/06*** | (2006.01) |
| ***F21V 15/01*** | (2006.01) |
| ***F21V 17/12*** | (2006.01) |
| ***F21V 33/00*** | (2006.01) |
| ***F21V 3/02*** | (2006.01) |
| ***F21Y 115/10*** | (2016.01) |
| ***F21Y 105/18*** | (2016.01) |

(52) U.S. Cl.

CPC ..... *F21V 17/164* (2013.01); *F21S 8/063* (2013.01); *F21V 3/02* (2013.01); *F21V 15/01* (2013.01); *F21V 17/12* (2013.01); *F21V 33/0096* (2013.01); *F21Y 2105/18* (2016.08); *F21Y 2115/10* (2016.08)

(58) Field of Classification Search

CPC ..... F21V 17/164; F21V 3/02; F21V 15/01; F21V 17/12; F21V 33/0096; F21V 29/773; F21V 9/16; F21S 8/063; F21Y 2105/18; F21Y 2115/10; F21Y 2101/02; F04D 19/002; F04D 29/239; F04D 25/06; F04D 29/5853

USPC ..... 362/147

See application file for complete search history.

(56) References Cited

U.S. PATENT DOCUMENTS

2015/0330619 A1* 11/2015 Iwamoto ..... F04D 19/002 416/5

* cited by examiner

*Primary Examiner* — Cara E Rakowski
*Assistant Examiner* — Jessica M Apenteng
(74) *Attorney, Agent, or Firm* — Rosenberg, Klein & Lee

(57) ABSTRACT

A light cover assembling structure has a light housing, a mounting sleeve, a light-emitting element, a transparent light cover, and a supporting cover. The mounting sleeve has an inner end mounted in the light housing and an outer end extending out of the light housing. An inner surface of the light housing and an outer surface of the mounting sleeve form an assembling space. The transparent light cover is mounted on the outer end of the mounting sleeve. The supporting cover is mounted on the outer end of the mounting sleeve, and has a first supporting side wall formed circumferentially and abutting the transparent light cover. The first supporting side wall of the supporting cover supports the transparent light cover such that the transparent light cover is firmly mounted on the mounting sleeve.

13 Claims, 12 Drawing Sheets

LIGHT COVER ASSEMBLING STRUCTURE OF A CEILING FAN

BACKGROUND OF THE INVENTION

1. Field of the Invention

The present invention relates to a light, especially to a light mounted with a ceiling fan.

2. Description of the Prior Arts

A light-emitting diode (LED) is used in lamps as a light source commonly. The LED has multiple advantages such as low energy consumption, long service life, and high power. In conventional lamps, a light cover is mounted on a light housing directly by only one buckling structure without any other supporting element, so the cover is mounted on the light housing unstably. Due to the shaking occurring in use, the cover is prone to fall off from the light housing and break.

To overcome the shortcomings, the present invention provides a light cover assembling structure of a ceiling fan to mitigate or obviate the aforementioned problems.

SUMMARY OF THE INVENTION

The main objective of the present invention is to provide a light cover assembling structure of a ceiling fan, wherein a transparent light cover is mounted stably and is prevented from falling off due to shaking.

The light cover assembling structure has a light housing, a mounting sleeve, a light-emitting element, a transparent light cover, and a supporting cover. The mounting sleeve has an inner end and an outer end. The inner end is mounted in the light housing. The outer end extends out of the light housing. An inner surface of the light housing and an outer surface of the mounting sleeve form an assembling space. The light-emitting element is mounted in the assembling space. The transparent light cover is mounted on the outer end of the mounting sleeve. The supporting cover is detachably mounted on the outer end of the mounting sleeve and has a first supporting side wall formed circumferentially and abutting the transparent light cover.

In the abovementioned light cover assembling structure, the transparent light cover is mounted on the mounting sleeve, and the first supporting side wall of the supporting cover supports the transparent light cover so that the transparent light cover is mounted firmly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
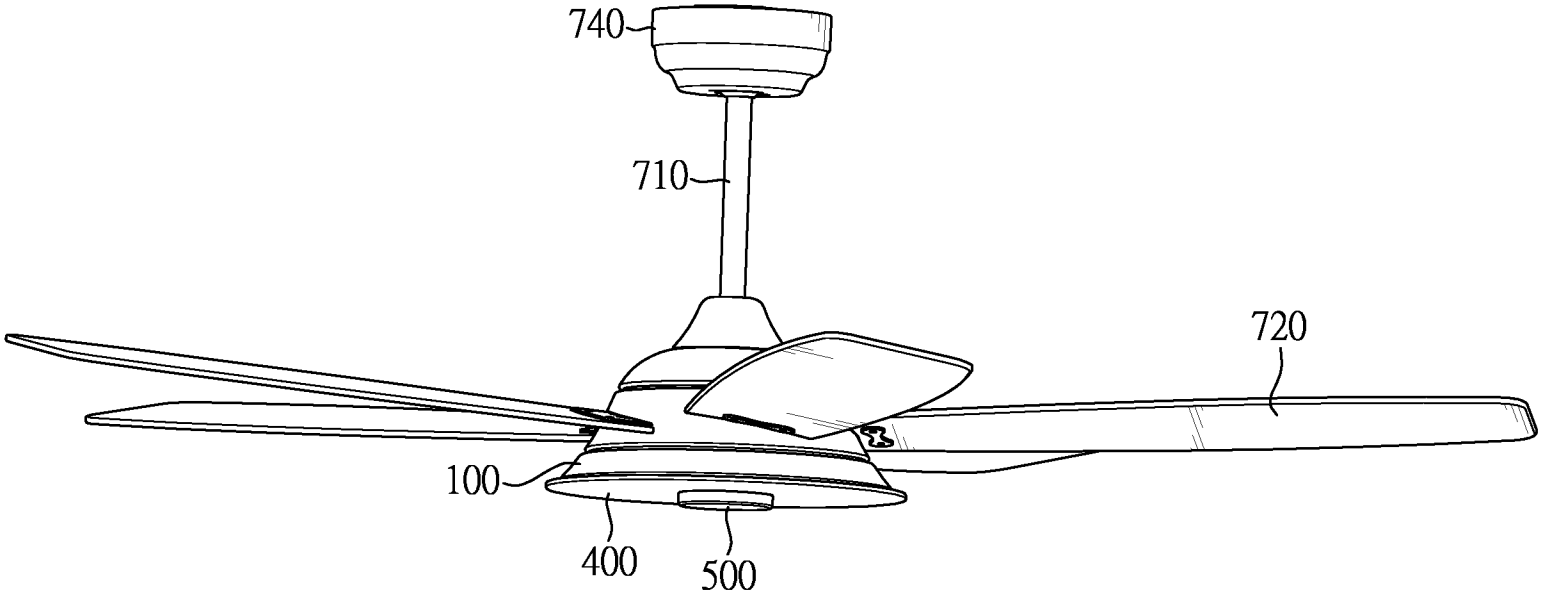
FIG. 1 is a perspective view of a light cover assembling structure of a ceiling fan in accordance with the present invention, showing the light cover assembling structure applied in a ceiling fan.

With reference to FIGS. 3 to 6, a light cover assembling structure in accordance with the present invention comprises a light housing 100, a mounting sleeve 200, a light-emitting element 300, a transparent light cover 400, and a supporting cover 500.

The mounting sleeve 200 has an inner end and an outer end. The inner end is mounted in the light housing 100, and the outer end extends out of the light housing 100. The transparent light cover 400 is mounted on the outer end of the mounting sleeve 200. Specifically, an opening 410 is formed on a center of the transparent light cover 400, and the transparent light cover 400 is mounted around the mounting sleeve 200 via the opening 410. Additionally, the transparent light cover 400 can be mounted on the mounting sleeve 200 by screw threading, bonding, or buckling. An inner surface of the light housing 100 and an outer surface of the mounting sleeve 200 together form an assembling space 201 configured to accommodate the light-emitting element 300. The supporting cover 500 is detachably mounted on the outer end of the mounting sleeve 200. The supporting cover 500 has a first supporting side wall 510 formed circumferentially and abutting the transparent light cover 400. The light-emitting element 300 can be an LED board or a light bulb, and the transparent light cover 400 can be a glass plate or an acrylic sheet.

In the abovementioned light cover assembling structure, the transparent light cover 400 is mounted on the mounting sleeve 200, and the first supporting side wall 510 of the supporting cover 500 abuts and supports the transparent light cover 400 such that the transparent light cover 400 is mounted more stably.

The abovementioned light cover assembling structure can be applied to lamps or ceiling fans.

Figure 2A:
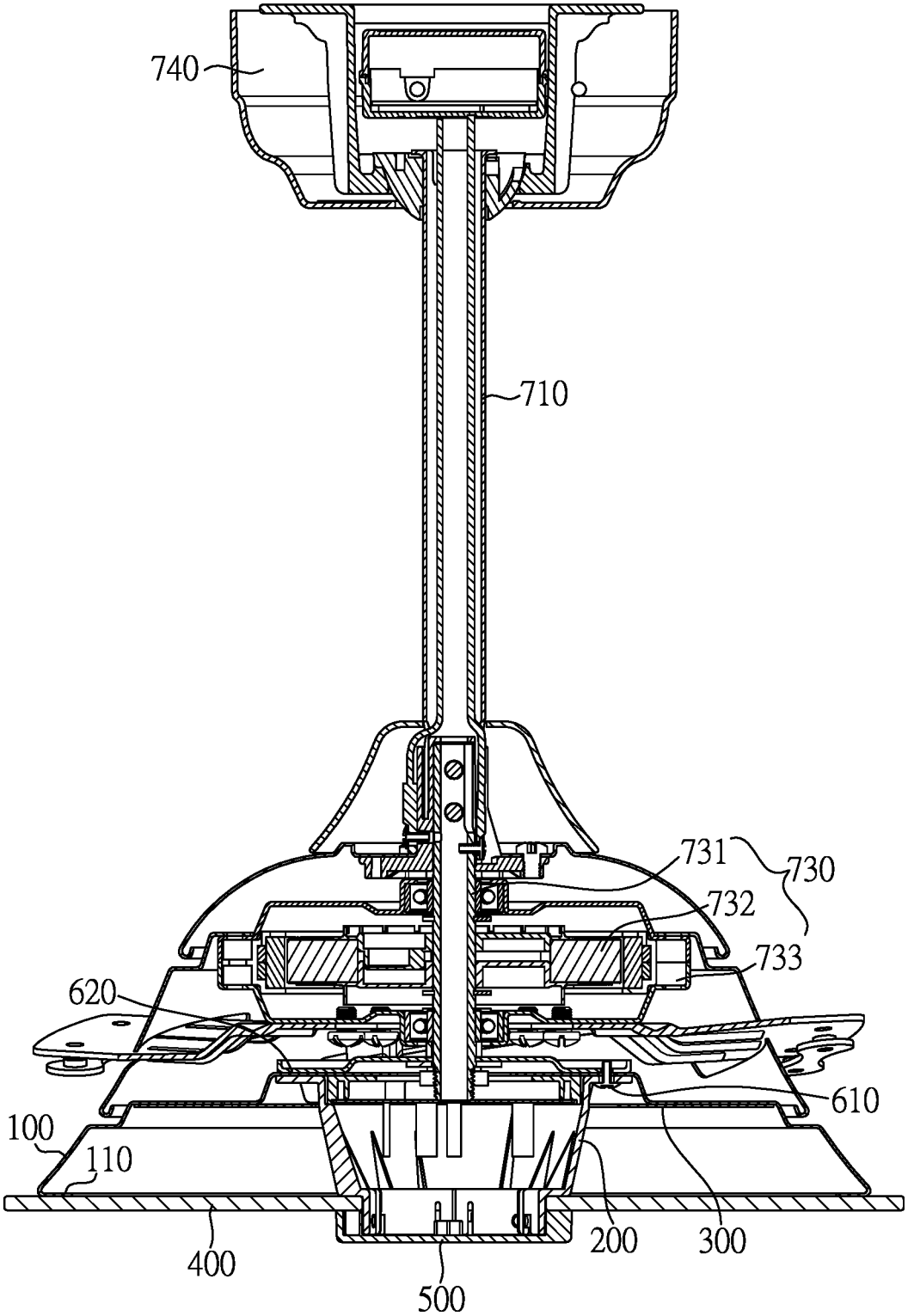
FIG. 2A is a side view in cross section of the light cover assembling structure in FIG. 1, showing the ceiling fan without fan blades.
Figure 2B:
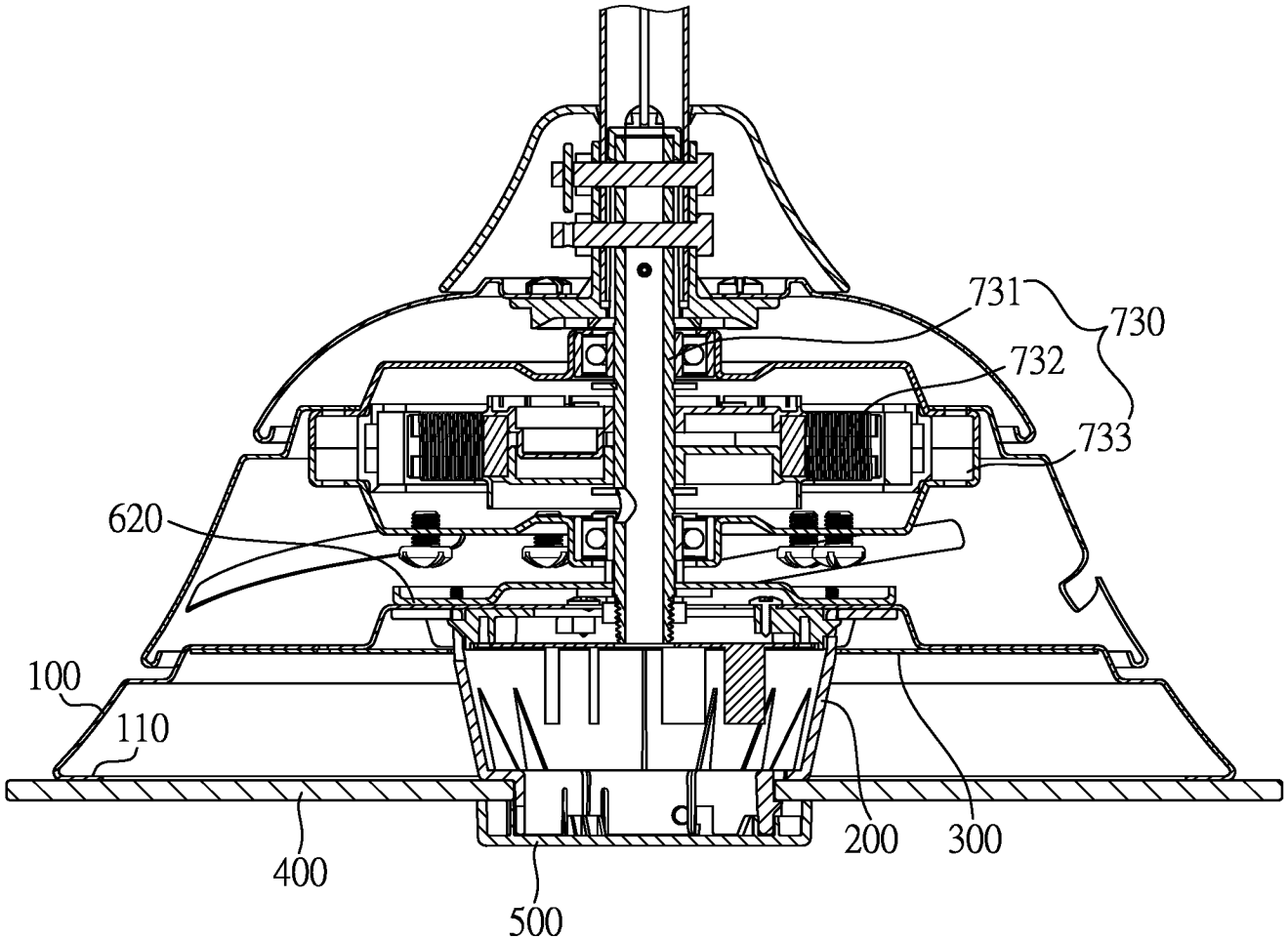
FIG. 2B is another side view in cross section of the light cover assembling structure in FIG. 1, showing the ceiling fan without fan blades.
Figure 3:
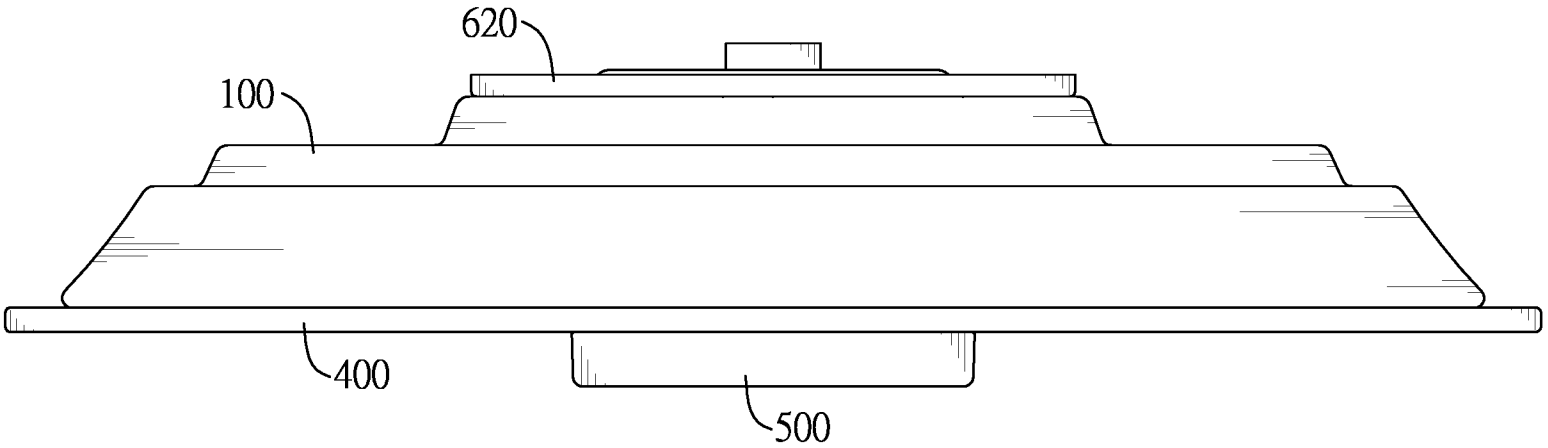
FIG. 3 is a side view of the light cover assembling structure in FIG. 1.
Figure 4A:
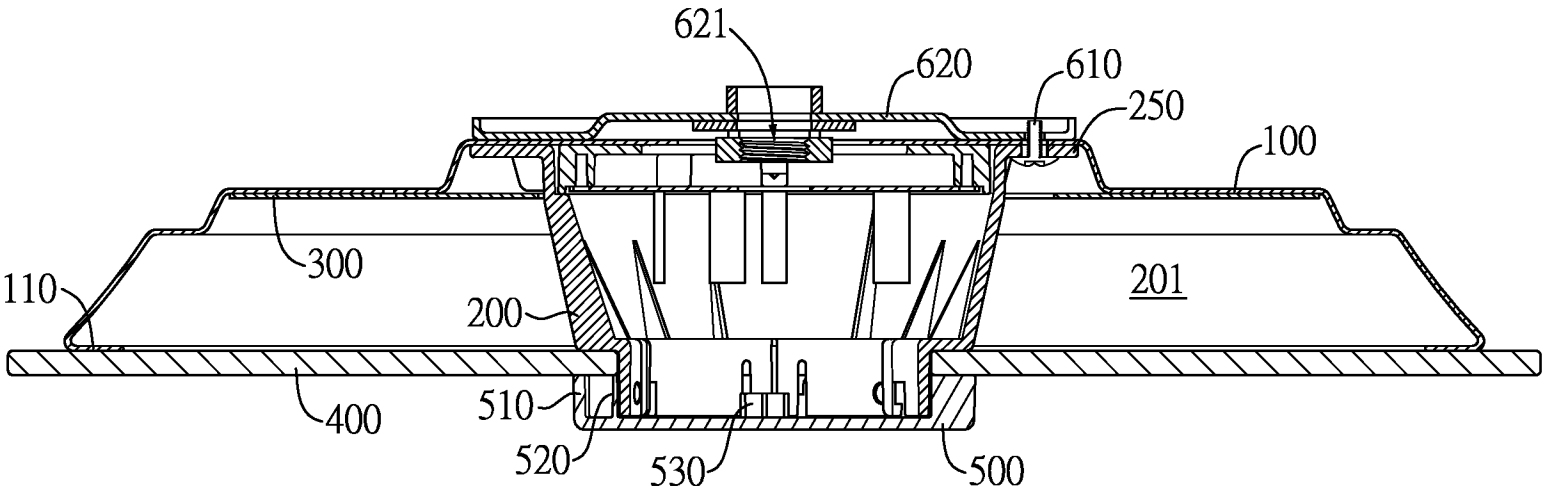
FIG. 4A is a side view in cross section of the light cover assembling structure in FIG. 1.
Figure 4B:
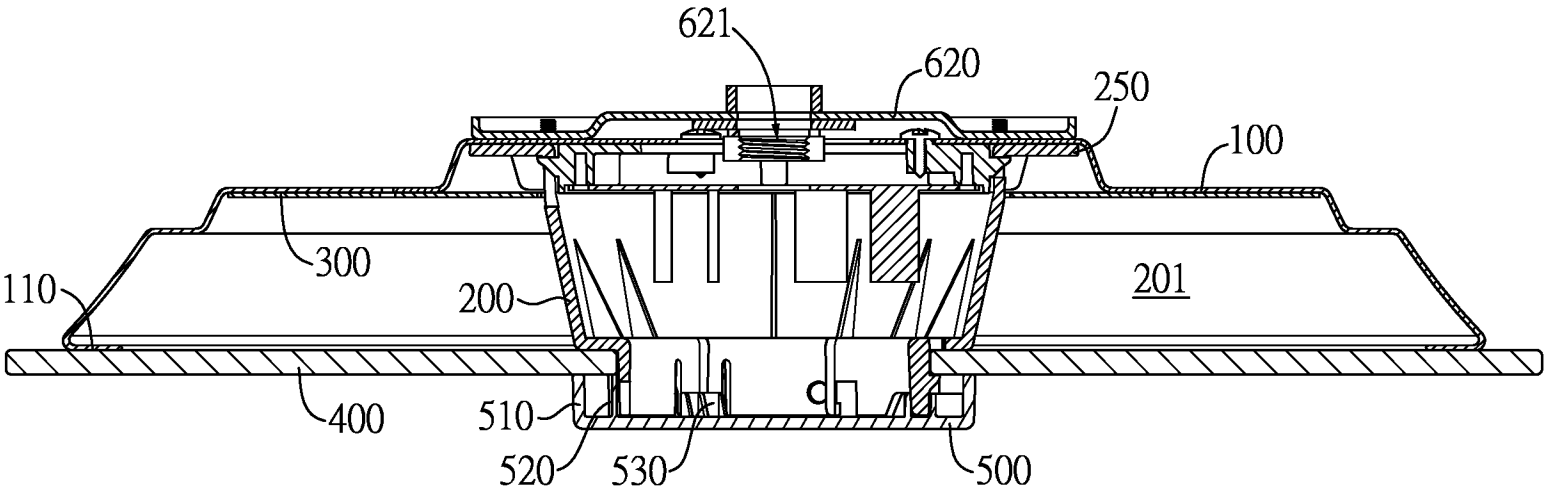
FIG. 4B is another side view in cross section of the light cover assembling structure in FIG. 1.
Figure 5:
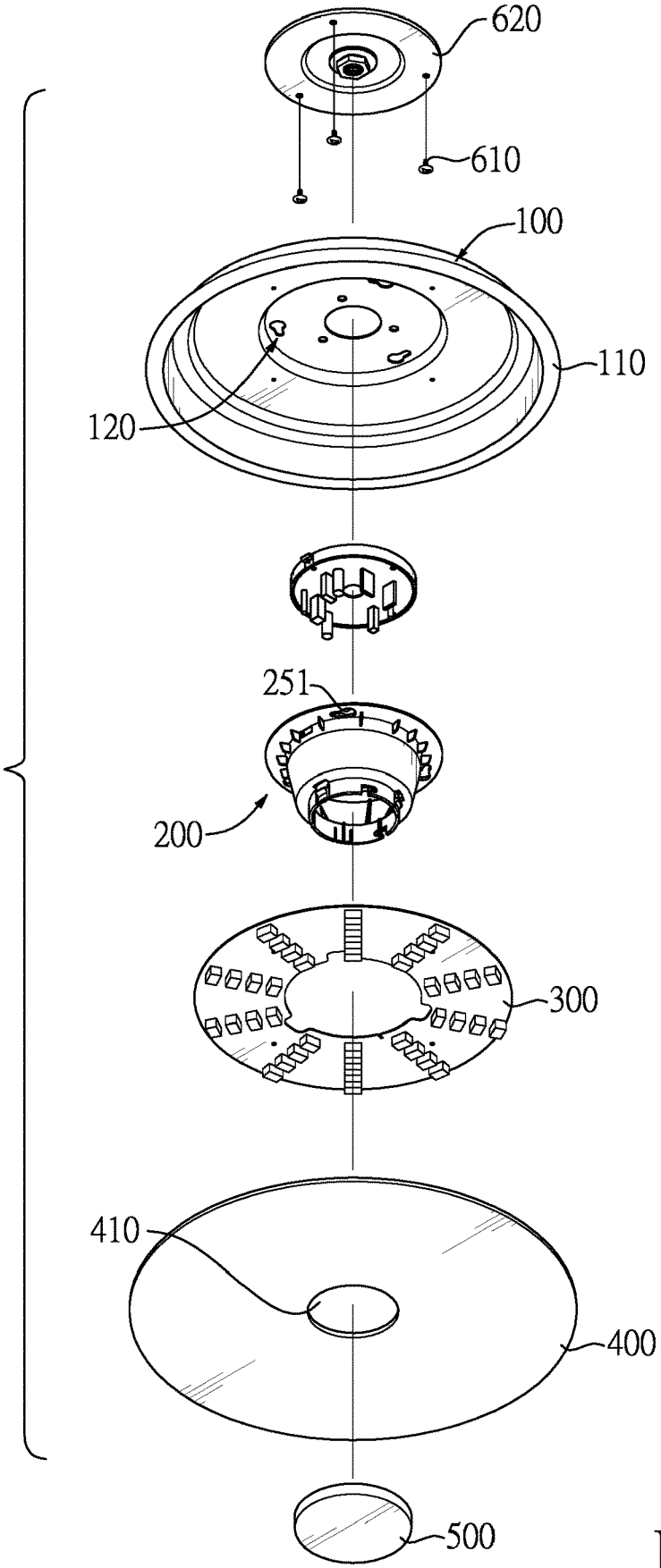
FIG. 5 is an exploded view of the light cover assembling structure in FIG. 1.
Figure 6:
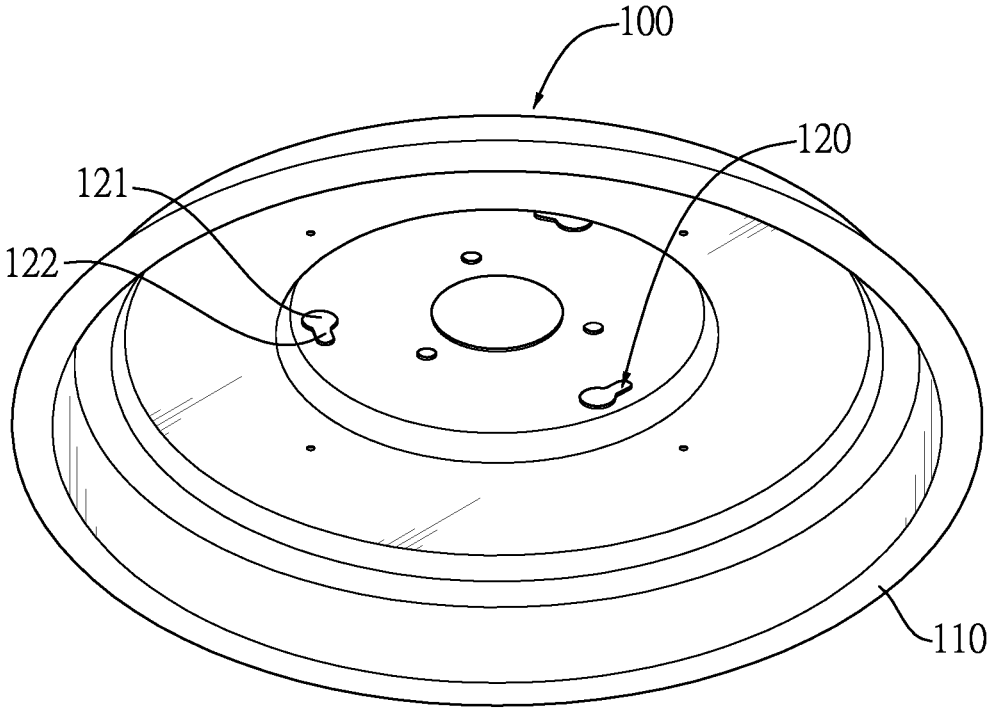
FIG. 6 is a perspective view of the light cover assembling structure in FIG. 1, showing the light housing.
Figure 7A:
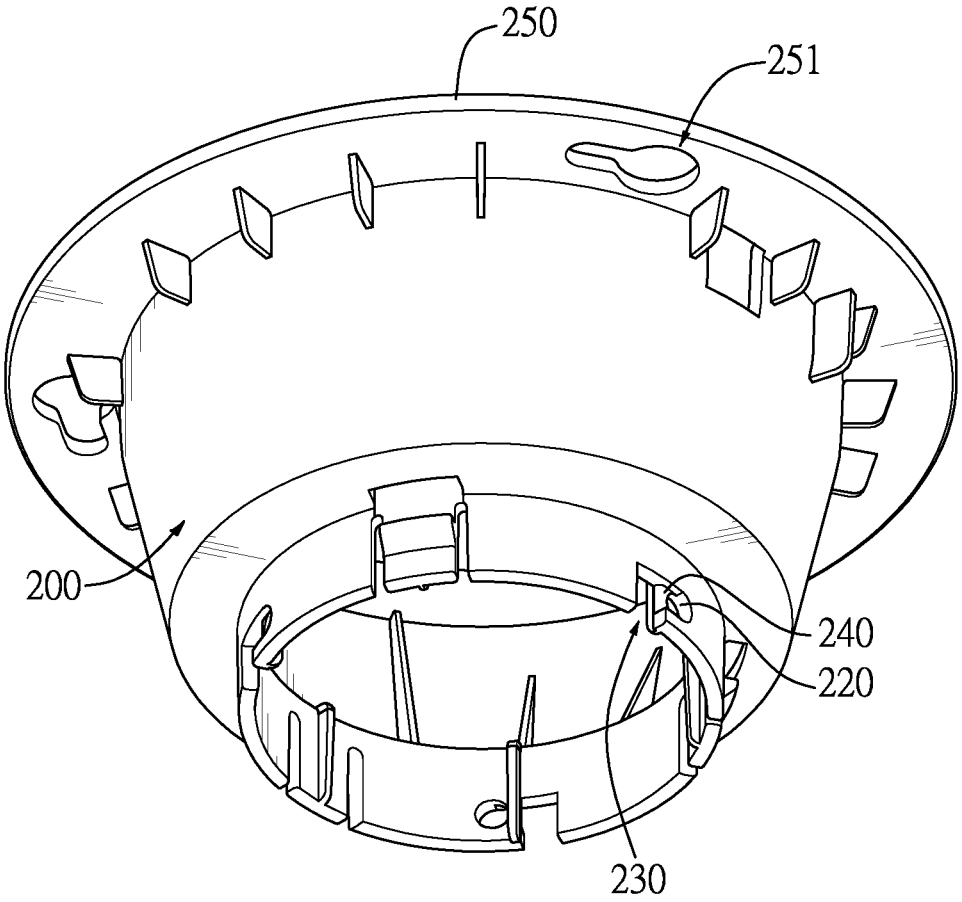
FIG. 7A is a perspective view of the light cover assembling structure in FIG. 1, showing the mounting sleeve.
Figure 7B:
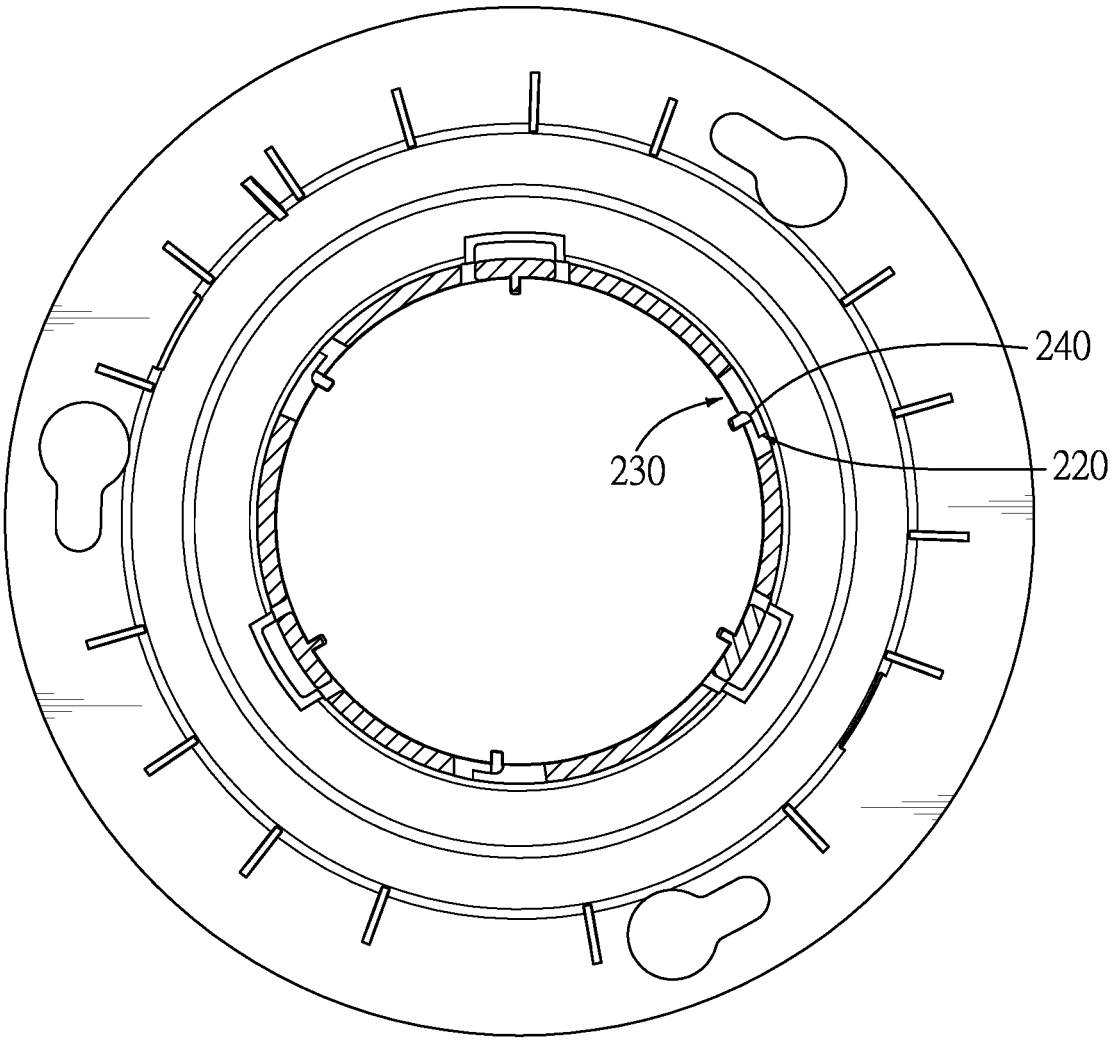
FIG. 7B is a bottom view in cross section of the light cover assembling structure in FIG. 1, showing the mounting sleeve.

For example, with reference to FIGS. 1, 2A and 2B, a ceiling fan in accordance with the present invention comprises a main body and the abovementioned light cover assembling structure. The main body has a hanging rod 710, multiple fan blades 720, and a motor 730. The motor 730 has a motor spindle 731, a stator 732, and a rotor 733. An end of the motor spindle 731 is connected to the hanging rod 710, and another end of the motor spindle 731 is connected to the light housing 100 of the light cover assembling structure. The stator 732 is connected to the motor spindle 731. The stator 732 is located at an inner side of the rotor 733. The rotor 733 is connected to the fan blades 720. The hanging rod 710 is fixed to a hanging base 740 mounted to the ceiling.

The light housing 100 is directly or indirectly mounted on the motor spindle 731 of the motor 730. The transparent light cover 400 is mounted on the mounting sleeve 200, and the first supporting side wall 510 of the supporting cover 500 abuts and supports the transparent light cover 400 such that the transparent light cover 400 is mounted more stably. The light-emitting element 300 emits light in the assembling space and the light passes through the transparent light cover 400 for illumination. The rotor 733 drives the fan blades 720 to rotate for fanning.

The supporting cover 500 can be mounted on the mounting sleeve 200 in various ways such as buckling, bonding, or screw threading.

For example, with reference to FIGS. 4A to 9, the supporting cover 500 further has a second supporting side wall 520 formed circumferentially and located at an inner side of the first supporting side wall 510. At least one buckling rod 521 is mounted on one of the second supporting side wall 520 and the mounting sleeve 200. At least one buckling hole 220 is formed on the other one of the second supporting side wall 520 and the mounting sleeve 220, and the at least one buckling hole 220 is complementary with the at least one buckling rod 521 for buckling. The supporting cover 500 is detachably mounted on the mounting sleeve 200 via the buckling rod 521 buckling into the buckling hole 220. Thus, the supporting cover 500 will be mounted or detached easily.

Specifically, at least one first reinforcing rib 540 is connected between the first supporting side wall 510 and the second supporting side wall 520. The first reinforcing rib 540 strengthens the first supporting side wall 510, the second supporting side wall 520, and the connection between the first supporting side wall 510 and the second supporting side wall 520, such that the first supporting side wall 510 supports the transparent light cover 400 firmly.

In a preferred embodiment, the supporting cover 500 further has at least one limiting protrusion 530 located at an inner side of the second supporting side wall 520. The at least one limiting protrusion 530 and the second supporting side wall 520 together form a gap 531 to accommodate the outer end of the mounting sleeve 200. Therefore, the limiting protrusion 530 and the second supporting side wall 520 clamp the end of the mounting sleeve 200 and thereby strengthen the overall structure.

Furthermore, with reference to FIGS. 4A to 9, the amount of the at least one limiting protrusion 530 is more than two. With the at least three limiting protrusions 530 formed circumferentially on the supporting cover 500, the supporting cover 500 supports the end of the mounting sleeve 200 more stably. Besides, the amount of the at least one buckling rod 521 of the second supporting side wall 520 is same as that of the limiting protrusions 530. The buckling rods 521 and the limiting protrusions 530 are disposed in a staggered manner. Thus, the mounting sleeve 200 is not only buckled by the buckling rods 521 but also clamped by the limiting protrusions 530, and because the buckling rods 521 and the limiting protrusions 530 are staggered evenly, the mounting sleeve 200 and the supporting cover 500 are connected firmly.

Selectively, a second reinforcing rib 550 is mounted between the at least one limiting protrusion 530 and the supporting cover 500.

In a preferred embodiment, with reference to FIGS. 4A to 9, the at least one buckling rod 521 is mounted on the supporting cover 500, and the at least one buckling hole 220 is formed on the mounting sleeve 200. The mounting sleeve 200 further has at least one notch 230 communicating with the at least one buckling hole 220. The supporting cover 500 is buckled to the mounting sleeve 200 by the buckling rod 521 passing through the notch 230 and then entering the buckling hole 220. The aforementioned assembly is easy and efficient because a user only has to insert the buckling rod 521 through the notch 230 and then rotate the supporting cover 500, and the supporting cover 500 and the mounting sleeve 200 are assembled. Selectively, a distance between the buckling hole 220 and the notch 230 ranges from 1 millimeter (mm) to 10 mm, such that the structural strength is ensured while the buckling rod 521 is moved with ease from the notch 230 to the buckling hole 220.

Figure 8:
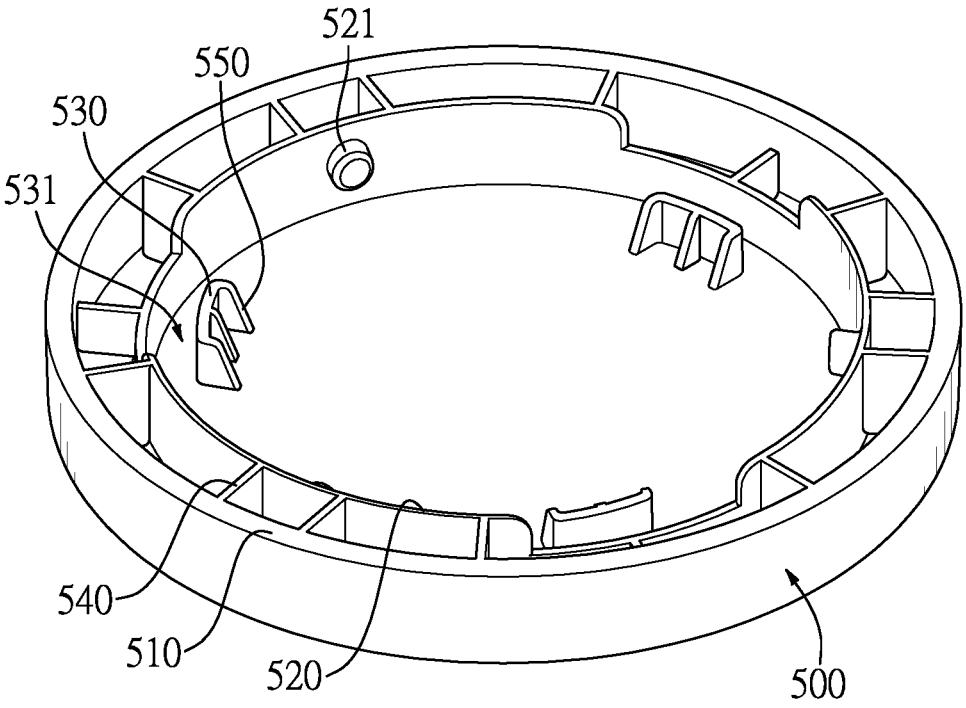
FIG. 8 is a perspective view of the light cover assembling structure in FIG. 1, showing the supporting cover.
Figure 9:
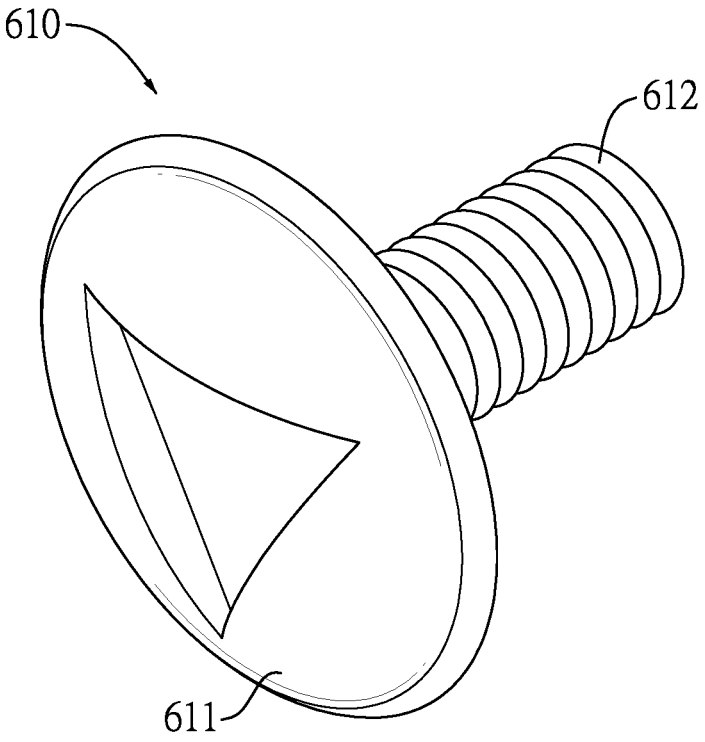
FIG. 9 is a perspective view of the light cover assembling structure in FIG. 1, showing the screw.

Furthermore, with reference to FIG. 8, at least one guiding curved surface 240 is formed on the second supporting side wall 520 and is located between the at least one notch 230 and the at least one buckling hole 220. The guiding curved surface 240 is adapted to guide the buckling rod 521 from the notch 230 into the buckling hole 220 so that the buckling rod 521 is buckled smoothly into the buckling hole 220 when the user rotates the supporting cover 500.

In a preferred embodiment, with reference to FIGS. 4A to 7B, an end of the light housing 100 near the transparent light cover 400 bends inward to form a bending edge. The bending edge abuts a periphery of the transparent light cover 400. The light housing 100 bends inward and forms a first bending edge 110. The first bending edge 110 has sufficient structural strength and abuts the transparent light cover 400 firmly. The periphery of the transparent light cover 400 is abutted by the first bending edge 110 firmly and the center of the transparent light cover 400 is mounted on the mounting sleeve 200 so that the force applied on the transparent light cover 400 is distributed in balance and the transparent light cover 400 is mounted firmly.

In a preferred embodiment, with reference to FIGS. 4A to 6, and 10, the light cover assembling structure further comprises at least one screw 610 and a fixing board 620. The fixing board 620 is adapted to be mounted on the motor spindle 731 of the motor 730 of the ceiling fan, and has at least one threaded hole 621 adapted to be assembled with the at least one screw 610. Each of the at least one screw 610 has a head 611 and a rod 612 connected to each other. The light housing 100 further has at least one first connecting hole 120 formed on an end surface, which is away from the transparent light cover 400, of the light housing 100. Each of the at least one first connecting hole 120 has a first hole segment 121 and a second hole segment 122 communicating to each other. A diameter of the first hole segment 121 is larger than a diameter of the head 611 of the least one screw 610. A diameter of the second hole segment 122 is smaller than the diameter of the head 611 of the at least one screw 610, and the diameter of the second hole segment 122 is larger than a diameter of the rod 612 of the least one screw 610.

By the aforementioned structure and the following steps, the fixing board 620 is mounted to the motor spindle 731. First, drive the screw 610 and mount half of the rod 612 through the threaded hole 621 of the fixing board 620, and the head 611 of the screw 610 is placed downward during driving. Then, when assembling the light housing 100 with the fixing board 620, align the first hole segment 121 to the head 611 of the screw 610 and insert the head 611 of the screw 610 through the first hole segment 121, and then move (rotate) the light housing 100 to insert the rod 612 of the screw 610 into the second hole segment 122. After that, drive the screw 610 tight to make the head 611 of the screw 610 abut a periphery of the second hole segment 122 tightly. After the screw 610 is mounted through the second hole segment 122 and the threaded hole 621 in sequence, the light housing 100 is assembled with the fixing board 620. The aforementioned assembling steps are easy and the connection between the light housing 100 and the fixing board 620 is firm.

With further reference to FIGS. 8, the inner end of the mounting sleeve 200 forms at least one second connecting hole 251 corresponding in position to the at least one first connecting hole 120. A shape of the at least one second connecting hole 251 is same as a shape of the at least one first connecting hole 120.

Therefore, when assembling the light housing 100 and the mounting sleeve 200 with the fixing board 620, first drive the screw 610 and mount half of the rod 612 through the threaded hole 621 of the fixing board 620. Then, align the first hole segment 121 and the second connecting hole 251 of the mounting sleeve 200 to the head 611 of the screw 610. Next, move (rotate) the light housing 100 and the mounting sleeve 200 and then drive the screw 610 tight. After then, the screw 610 is mounted through the second connecting hole 251, the first connecting hole 120, and the threaded hole 621 in sequence so that the screw 610 fixes the mounting sleeve 200, the light housing 100, and the fixing board 620 at once. Thus, the assembling steps of the mounting sleeve 200, the light housing 100, and the fixing board 620 are easy and efficient.

An amount of the at least one threaded hole 621 of the fixing board 620 can be more than two. Correspondingly, an amount of the at least one screw 610, an amount of the at least one first connecting hole 120, and an amount of the at least one second connecting hole 251 can be more than two. For example, the light cover assembling structure has three screws 610 in a preferred embodiment.

Specifically, the end of the mounting sleeve 200 located inside the light housing 100 bends outward and forms a second bending edge 250. The at least one second connecting hole 251 is formed on the second bending edge 250.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A light cover assembling structure of a ceiling fan; the light cover assembling structure comprising:
- a light housing;
- a mounting sleeve having
  - an inner end mounted in the light housing; and
  - an outer end extending out of the light housing; an inner surface of the light housing and an outer surface of the mounting sleeve forming an assembling space;
- a light-emitting element mounted in the assembling space;
- a transparent light cover mounted on the outer end of the mounting sleeve; wherein an end of the light housing near the transparent light cover bends inward to form a bending edge; the bending edge abuts the transparent light cover; and
- a supporting cover detachably mounted on the outer end of the mounting sleeve; the supporting cover having
  - a first supporting side wall formed circumferentially and abutting the transparent light cover.

2. The light cover assembling structure as claimed in claim 1, wherein
- the supporting cover further has
  - a second supporting side wall formed circumferentially and located at an inner side of the first supporting side wall;
- at least one buckling rod is mounted on one of the second supporting side wall and the mounting sleeve;
- at least one buckling hole is formed on the other one of the second supporting side wall and the mounting sleeve; the at least one buckling hole is complementary with the at least one buckling rod for buckling.

3. The light cover assembling structure as claimed in claim 2, wherein at least one first reinforcing rib is connected between the first supporting side wall and the second supporting side wall.

4. The light cover assembling structure as claimed in claim 3, wherein the supporting cover further has
- at least one limiting protrusion located at an inner side of the second supporting side wall; the at least one limiting protrusion and the second supporting side wall forming a gap to accommodate the outer end of the mounting sleeve.

5. The light cover assembling structure as claimed in claim 4, wherein
- the at least one buckling rod is mounted on the supporting cover;
- the at least one buckling hole is formed on the mounting sleeve; the mounting sleeve further has at least one notch communicating with the at least one buckling hole.

6. The light cover assembling structure as claimed in claim 5, wherein the second supporting side wall further has
- at least one guiding curved surface formed between the at least one notch and the at least one buckling hole; the at least one guiding curved surface adapted to guide the at least one buckling rod to enter the at least one buckling hole from the at least one notch.

7. The light cover assembling structure as claimed in claim 6, wherein
- the light cover assembling structure further has
  - at least one screw each having a head and a rod connected to each other; and
  - a fixing board adapted to be mounted on a motor spindle of a ceiling fan; the fixing board having at least one threaded hole adapted to be assembled with the at least one screw;
- the light housing further has
  - at least one first connecting hole formed on an end surface, which is away from the transparent light cover, of the light housing; each of the at least one first connecting hole having
    - a first hole segment; a diameter of the first hole segment is larger than a diameter of the head of the at least one screw; and
    - a second hole segment communicating with the first hole segment; a diameter of the second hole segment being smaller than the diameter of the head of the at least one screw and the diameter of the second hole segment being larger than a diameter of the rod of the at least one screw.

8. The light cover assembling structure as claimed in claim 7, wherein the mounting sleeve further has
- at least one second connecting hole formed on the inner end of the mounting sleeve; a shape of the at least one second connecting hole being same as a shape of the at least one first connecting hole; the at least one second connecting hole corresponding in position to the at least one first connecting hole.

9. The light cover assembling structure as claimed in claim 2, wherein the supporting cover further has at least one limiting protrusion located at an inner side of the second supporting side wall; the at least one limiting protrusion and the second supporting side wall forming a gap to accommodate the outer end of the mounting sleeve.

10. The light cover assembling structure as claimed in claim 2, wherein the at least one buckling rod is mounted on the supporting cover;

the at least one buckling hole is formed on the mounting sleeve; the mounting sleeve further has at least one notch communicating with the at least one buckling hole.

11. The light cover assembling structure as claimed in claim 10, wherein the second supporting side wall further has at least one guiding curved surface formed between the at least one notch and the at least one buckling hole; the at least one guiding curved surface adapted to guide the at least one buckling rod to enter the at least one buckling hole from the at least one notch.

12. The light cover assembling structure as claimed in claim 1, wherein the light cover assembling structure further has at least one screw each having a head and a rod connected to each other; and a fixing board adapted to be mounted on a motor spindle of a ceiling fan; the fixing board having at least one threaded hole adapted to be assembled with the at least one screw;

the light housing further has at least one first connecting hole formed on an end surface, which is away from the transparent light cover, of the light housing; each of the at least one first connecting hole having a first hole segment; a diameter of the first hole segment is larger than a diameter of the head of the at least one screw; and a second hole segment communicating with the first hole segment; a diameter of the second hole segment being smaller than the diameter of the head of the at least one screw and the diameter of the second hole segment being larger than a diameter of the rod of the at least one screw.

13. The light cover assembling structure as claimed in claim 12, wherein the mounting sleeve further has at least one second connecting hole formed on the inner end of the mounting sleeve; a shape of the at least one second connecting hole being same as a shape of the at least one first connecting hole; the at least one second connecting hole corresponding in position to the at least one first connecting hole.

* * * * *